United States Patent [19]

Seidler

[11] Patent Number: 4,902,152

[45] Date of Patent: Feb. 20, 1990

[54] NAIL ENAMEL PEN

[75] Inventor: David Seidler, Forest Hills, N.Y.

[73] Assignee: Lever Brothers Company, New York, N.Y.

[21] Appl. No.: 243,130

[22] Filed: Sep. 9, 1988

Related U.S. Application Data

[63] Continuation of Ser. No. 873,007, Jun. 11, 1986, abandoned.

[51] Int. Cl.[4] ..... A45D 34/00; A46B 11/02

[52] U.S. Cl. ..... 401/117; 401/116; 401/269; 401/288; 401/183

[58] Field of Search ..... 401/102, 116, 117, 183, 401/288, 269

[56] References Cited

U.S. PATENT DOCUMENTS

| | | | |
|---|---|---|---|
| 874,897 | 12/1907 | Moore . | |
| 2,782,438 | 2/1957 | Wittnebert et al. . | |
| 2,847,691 | 8/1958 | Edelstone et al. . | |
| 2,849,738 | 9/1958 | Hopkins . | |
| 2,887,708 | 5/1959 | Kane . | |
| 2,944,274 | 7/1960 | Hopkins . | |
| 2,945,252 | 7/1960 | Martineau, Jr. . | |
| 3,144,676 | 8/1964 | LaMura . | |
| 3,192,552 | 7/1965 | King . | |
| 3,331,094 | 7/1967 | Schwartzman . | |
| 3,420,611 | 1/1969 | Towns . | |
| 3,655,290 | 4/1972 | Griffith . | |
| 3,797,946 | 3/1974 | Witzmann et al. | 401/116 |
| 3,877,822 | 4/1975 | LaMura . | |
| 4,447,169 | 5/1984 | Vartoughian . | |
| 4,470,715 | 9/1984 | Ruchlin et al. . | |
| 4,548,524 | 10/1985 | Seager . | |

FOREIGN PATENT DOCUMENTS

| | | | |
|---|---|---|---|
| 1092603 | 4/1955 | France | 401/102 |
| 280036 | 2/1949 | Switzerland | 401/102 |
| 7095 | of 1906 | United Kingdom | 401/102 |

*Primary Examiner*—Steven A. Bratlie

*Attorney, Agent, or Firm*—Milton L. Honig

[57] ABSTRACT

A liquid applicator for applying a liquid to a surface such as fingernails. The applicator includes a squeezable container which holds the liquid and includes an open neck. A brush holder supports a hollow brush in the open neck. A sleeve in the open neck is displaceable by the container cap between a first position where the brush is exposed for use and a second position where the cap is sealed against the sleeve to prevent brush dry-out.

9 Claims, 3 Drawing Sheets

NAIL ENAMEL PEN

This is a continuation of application Ser. No. 873,007, filed June 11, 1986, now abandoned.

BACKGROUND OF THE INVENTION

The present invention is directed generally to a device for directly applying liquids to a surface and, in particular, to a nail enamel pen wherein the brush applicator forms a part of the container bottle for direct application of a nail enamel to a user's nails.

Conventional nail enamel or nail polish bottles generally include a hard glass or plastic container in which the nail polish is stored. The container includes an externally threaded neck. An internally threaded plastic cap having a stem extending downwardly therefrom is provided a brush on the end thereof. The cap acts to seal off the bottle and, when removed, the brush is utilized to apply the nail polish from the bottle to a user's nails. The brush and stem must be inserted through the neck of the bottle to refill the brush with polish for each application procedure.

Product flow control has proven difficult in such conventional nail enamel applicators since the amount of polish applied to the brush on each dipping cannot be properly controlled. In addition, excess product must be wiped off of the brush before application to the nails.

In recent years, there has been movement in the industry towards a nail polish container wherein the brush is affixed to the container and product flows directly from the bottle to the brush. Such attempts have proven less than completely satisfactory in that the brushes tend to dry out since they can not be sealed properly in the product environment. In addition, excess product tends to flow down the sides of the bottle both during and after use and product flow control is difficult.

It is therefore desired to provide an automatic liquid application system such as a nail enamel pen which overcomes the disadvantages encountered in prior art constructions.

SUMMARY OF THE INVENTION

The present invention provides a liquid applicator for applying a liquid to a surface. The applicator includes a squeezable bottle which contains a predetermined quantity of the liquid to be applied. The container includes an open neck through which the liquid can flow. A bottle plug and brush holder are supported in the open neck which holds a brush having an opening through which the liquid can flow. A sleeve is positioned intermediate the brush holder and bottle plug. This sleeve is displaceable between a first position where the brush is exposed for use and a second position where the brush is surrounded by the sleeve. A screw-on cap is provided which acts to displace the sleeve between its first and second positions when screwed on the container. The upper end of the sleeve seals against the inner portion of the cap when the sleeve is moved to its second position thereby retaining the brush in the environment of the liquid product to prevent the brush from drying out.

In a preferred embodiment, the sleeve cooperates with the inner surface of the bottle plug to provide a piston-type effect to draw excess product from the brush back into the container to prevent running and spilling of the product when the cap is secured to the container.

Accordingly, it is an object of the present invention to provide an improved liquid applicator having a combined container with attached brush.

Another object of the present invention is to provide a nail enamel pen having a brush appropriately secured to the product container for application of a nail polish which prevents drying out of the brush during storage.

A further object of the present invention is to provide a liquid applicator having a displacable sleeve which cooperates with the container cap to prevent drying out of the liquid and the applicator brush.

Yet another object of the present invention is to provide a liquid applicator having a container with attached brush with a displacable sleeve which provides a piston effect to draw excess product back into the container upon sealing thereof.

Yet another object of the present invention is to provide an improved nail enamel pen which is easy and inexpensive to manufacture.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding to the invention, reference is had to the following description taken in connection with the accompanying drawings, in which.

DESCRIPTION OF THE PREFERRED EMBODIMENTS

Figure 1:
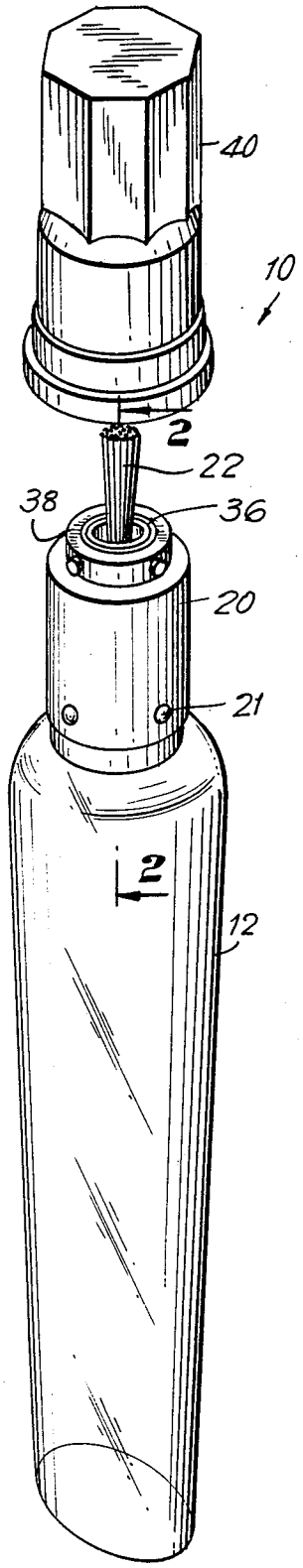
FIG. 1 is an elevational view of a liquid applicator such as a nail enamel pen, shown with the cap removed, constructed in accordance with a preferred embodiment of the present invention.

Reference is first made to FIG. 1 of the drawings which depicts a liquid applicator assembly such as a nail enamel pen, generally indicated at 10, constructed in accordance with a preferred embodiment of the present invention. Liquid applicator assembly 10 includes a squeezable container 12, a brush holder and sleeve assembly 20 having a brush 22, and a cap 40. In a preferred embodiment, container 12 is preferably formed from a transparent plastic material to permit viewing of the predetermined quantity of flowable product stored therein and is adapted to hold a predetermined quantity of a flowable product having a relatively high viscosity such as nail polish.

Referring now additionally to FIGS. 2 through 5, it is seen that container 12 includes an open neck 14 having a diameter which is smaller than the upper diameter of container 12.

A bottle plug 24 is tightly fitted on neck 14 of container 12. Bottle plug 24 includes an outer wall **24*a* and an inner wall 24*b*** spaced therefrom between which neck 14 of container 12 is fitted. Outer wall 24*a* includes a groove 24*c* which cooperates with a tongue 14*a* on neck 14 to lock bottle plug 24 onto neck 14. The inner surface 14*b* of neck 14 is also serrated to cooperate with projections 25 on the outer surface of inner wall 24*b* of bottle plug 24 so as to prevent turning of plug 24 with respect to neck 14.

Upper end 26 of plug 24 includes an inner sloping surface 27 which terminates in a vertical wall 28 having a plurality of serrations formed therein.

A brush holder 30 includes a lower enlarged ring 32 which is captured within an undercut 24*d* formed at the bottom of the inner surface of inner wall 24*b* of plug 24. Brush holder 30 includes an opening 31 extending along the entire length thereof. Ring 32 also includes several openings 32*a* therearound which are spaced outwardly from main opening 31 in brush holder 30. The upper end 30*a* of brush holder 30 is adapted to receive and hold the open stem 21 of brush 22. Brush 22 may be formed from a thermoplastic material and includes open stem 21 with bristles extending therefrom.

Figure 2:
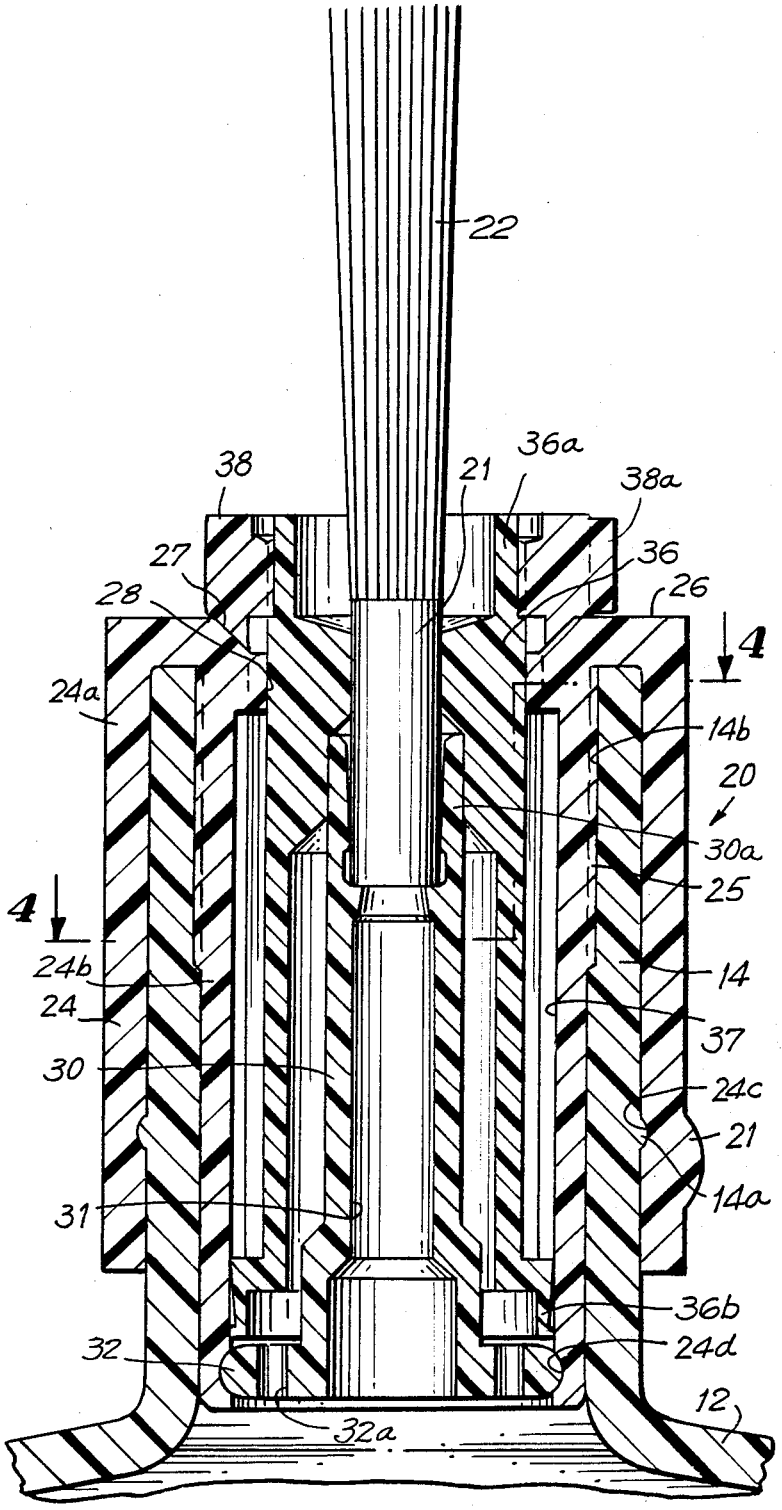
FIG. 2 is enlarged sectional view taken along line 2—2 of FIG. 1.
Figure 3:
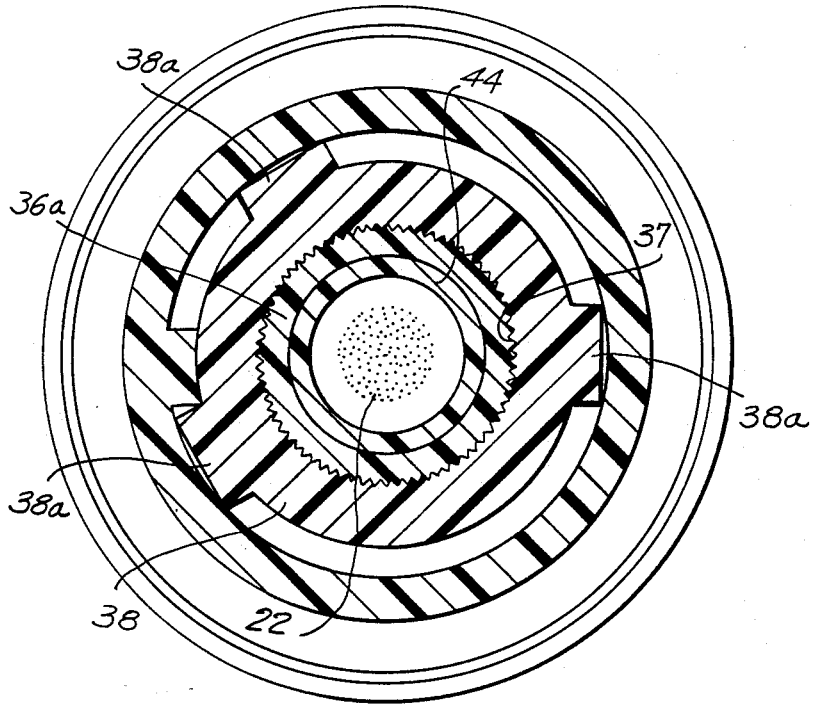
FIG. 3 is an enlarged sectional view taken along line 3—3 of FIG. 5.
Figure 4:
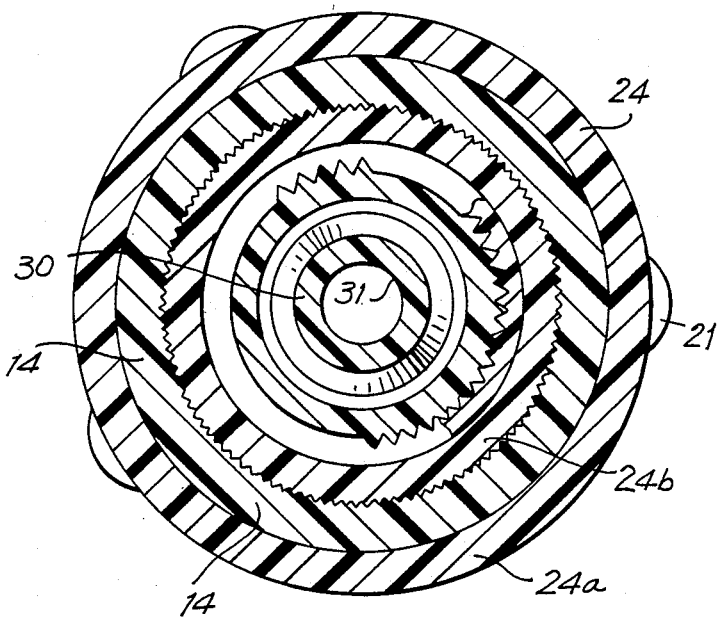
FIG. 4 is a sectional view taken along lines 4—4 of FIG. 2.
Figure 5:
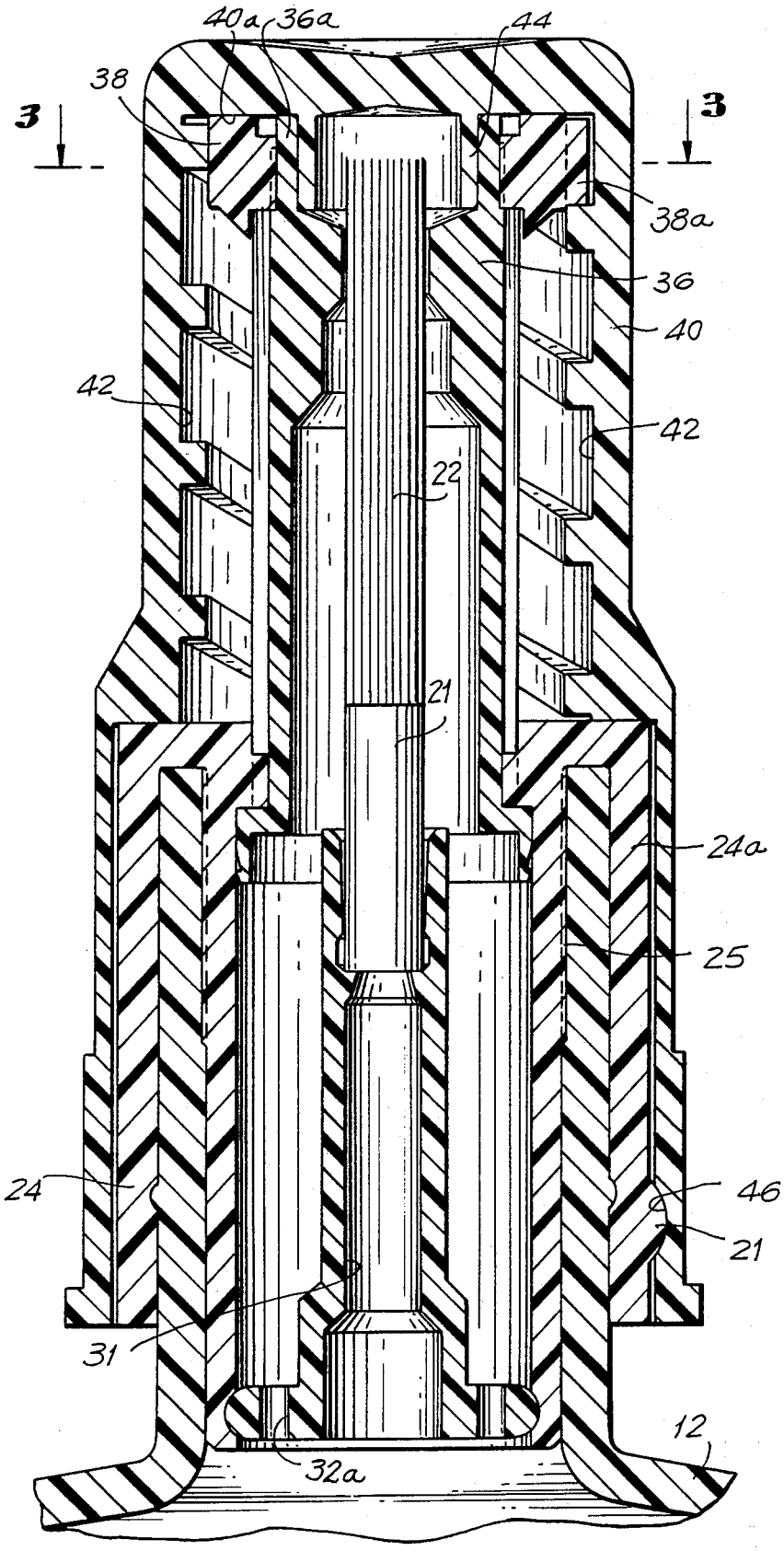
FIG. 5 is a sectional view similar to FIG. 2 but showing the cap in place and the sleeve displaced to its second position.

A sleeve 36 is slidable within bottle plug 24 between a first lower position depicted in FIG. 2 and a second upper position depicted in FIG. 5. Sleeve 36 includes a series of ribs 56 on the outer surface thereof which mate with serrations formed on vertical wall 28 of bottle plug 24 so as to be slidable therealong while rotation is prevented. Sleeve 36 includes an opening extending therealong. The upper end 36*a* of sleeve 36 defines an inner reservoir. The lower end 36*b* of sleeve 36 also defines a reservoir which is open to openings 32*a* in ring 32 of brush holder 30. The outer wall defining lower end 36*b* of sleeve 36 rides against the inner surface of inner wall 24*b* of brush holder 24 to provide a piston effect as more fully described below in detail.

A nut 38 is fixed to upper end 36*a* of sleeve 36 and includes serrations 57 to prevent rotation thereof. Nut 38 includes several projections 38*a* on the outer surface thereof.

Hollow cap 40 includes inner threads 42 adapted to capture projections 38*a* when cap 40 is screwed onto container 12. As more fully described below in detail, when cap 40 is inserted on plug 24 and rotated, sleeve 36 will be raised to its second upper position as depicted in FIG. 5. The inner surface 40*a* includes an annular projection 44 which extends into the upper reservoir formed at the upper end 36*a* of sleeve 36 so as to provide a sealed environment for brush 22.

The lower inner surface of cap 40 includes a groove 46 formed therearound which cooperates with a series of projections 21 on plug 24 to cause a snap fit between cap 40 and plug 24 around which cap 40 can be rotated to move sleeve 36.

In use, the configuration depicted in FIGS. 1 and 2 operates as follows. Sleeve 36 is in its lower position and brush 22 is exposed for use. By squeezing container 12, a desired, controlled amount of liquid product such as nail polish will be forced through brush holder 30 and brush stem 21 into brush 22 for application as desired. Due to the position of the upper end of sleeve 21 to brush 22, product will be delivered close to the tip of brush 22. Once application is completed, cap 40 is snapped onto bottle plug 24 wherein groove 46 engages projections 21. By turning cap 40 in a clockwise direction, projections 38*a* on nut 38 will engage in screw threads 42 in cap 40 thereby causing sleeve 36 to move upward to the second position depicted in FIG. 5. When in its upper position, annular projection 44 will extend into the reservoir at the top of sleeve 36 thereby sealing off brush 22 within the product area defined from container 12 and extending through neck 14 into sleeve 36. This will prevent brush 22 from drying out.

As sleeve 36 is raised, wall 36*b* thereof will ride against the inner surface of inner wall 24*b* of bottle plug 24 thereby providing a piston effect to draw excess product from the upper sleeve reservoir back through the brush stem and into container 12. This also prevents excess product from flowing down the sides of the container.

In a preferred embodiment, the cap and sleeve are formed from a nylon material. The bottle plug and brush holder may be formed from a polyethylene material. The nut on sleeve 36 is preferably made of a Delrin material for easy sliding.

The nail enamel pen of the present invention provides an improved structure for applying a nail polish to a user's nail. The construction is easy and inexpensive to manufacture. Nevertheless, brush dry out and spilling is substantially prevented by the construction and cooperation between the various parts as configured. Through the present device, each of the objects and advantages noted above are achieved.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A liquid applicator for applying a liquid to a surface comprising a squeezable container having an open neck adapted to hold said liquid, a container plug having an opening therethrough supported on said neck, an inward wall of said container plug having serrations formed therein, a brush holder having an opening extending therethrough supported in said container plug along the opening in said container plug, a hollow brush having an opening therein in fluid communication with the opening in said brush holder supported in said brush holder and extending out of said container plug, sleeve means disposed intermediate said container plug and said brush and brush holder and displaceable between a first position where said brush is exposed for use and a second position where said sleeve means surrounds said brush, said sleeve means including an elongated opening therethrough through which said brush extends, said liquid flowing into said brush holder opening and into said brush through the opening in said brush for application when said sleeve means is in said first position, said brush being exposed to said liquid both externally along the opening in said sleeve means and internally through the opening in said brush when said sleeve means is in said second position to prevent drying out of said brush, said sleeve means further including a series of ribs on an outer surface thereof which mate with said serrations in said container plug inward wall, and rotatable cap means removably coupleable to said container plug for moving said sleeve means between its first and second positions when rotated, said sleeve means including an upper surface, the upper surface of said sleeve means including an annular ring projecting inwardly contacting said brush and forming a base for a dish-shaped reservoir which encircles said brush, said cap means including sealing means which engages the reservoir in the upper surface of said sleeve means when said sleeve means is in its second position to seal said brush in the liquid environment of said container to prevent said brush from drying out.

2. The liquid applicator as claimed in claim 1, wherein said reservoir is pressed against said sealing means in said cap means when said sleeve means is in its second position.

3. The liquid applicator as claimed in claim 2, wherein said sealing means includes an annular projection on said cap means which extends into said reservoir when said sleeve means is in its second position to seal said brush.

4. The liquid applicator as claimed in claim 1, wherein said hollow brush includes a first end having an open stem supported in said brush holder and a second end having a plurality of bristles for application of said liquid.

5. The liquid applicator as claimed in claim 4, wherein said brush holder includes first and second ends, said open stem of said brush being supported in said first end of said brush holder, said second end of said brush holder including an annular ring having a plurality of openings therearound in fluid communication with said reservoir when said sleeve means is in the second position.

6. The liquid applicator as claimed in claim 1, wherein said container plug includes an inner surface, said sleeve means including a lower end which wipes against the inner surface of said container plug as said sleeve means is moved between its first and second positions.

7. The liquid applicator as claimed in claim 6, wherein said sleeve means creates a piston effect to draw liquid through said brush and brush holder and back into said container as said sleeve means is moved from its first to its second position.

8. The liquid applicator as claimed in claim 4, wherein said liquid in said container flows through said brush holder, through said stem of said brush and onto said bristles of said brush when said container is squeezed for application of said liquid by a user.

9. The liquid applicator as claimed in claim 1, wherein the diameter of said open container neck is smaller than the diameter of said container.

* * * * *